US006732964B2

(12) United States Patent
Couchey

(10) Patent No.: US 6,732,964 B2
(45) Date of Patent: May 11, 2004

(54) YARN WINDING TUBE WITH REMOVABLE END RING

(75) Inventor: Brian P. Couchey, Inman, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 10/184,207

(22) Filed: Jun. 28, 2002

(65) Prior Publication Data

US 2004/0000607 A1 Jan. 1, 2004

(51) Int. Cl.[7] ..... B65H 75/12
(52) U.S. Cl. ..... 242/118.32
(58) Field of Search ..... 242/118.3, 118.32, 242/125.1, 476.5, 476.6, 613, 608.5

(56) References Cited

U.S. PATENT DOCUMENTS

| | | | | | |
|---|---|---|---|---|---|
| 2,327,738 | A | | 8/1943 | Perry | |
| 2,765,129 | A | | 10/1956 | Dunlap | |
| 2,898,054 | A | * | 8/1959 | Rea | 450/122 |
| 3,801,038 | A | | 4/1974 | Wust | |
| 3,876,165 | A | | 4/1975 | Corner | |
| 3,967,795 | A | | 7/1976 | Shindo et al. | |
| 4,057,201 | A | | 11/1977 | Wilkinson | |
| 4,063,688 | A | | 12/1977 | Grellier | |
| 4,063,696 | A | | 12/1977 | Kelly et al. | |
| 4,184,653 | A | | 1/1980 | Bonzo | |
| 4,205,800 | A | * | 6/1980 | Melan et al. | 242/476.1 |
| 4,298,122 | A | | 11/1981 | Ekelund | |
| 4,369,933 | A | | 1/1983 | Bedenbaugh | |
| 4,371,130 | A | | 2/1983 | Case | |
| 4,834,314 | A | | 5/1989 | Powel et al. | |
| 4,842,213 | A | | 6/1989 | Bartschi et al. | |
| 4,874,139 | A | * | 10/1989 | Kewin | 242/609.4 |
| 4,901,941 | A | | 2/1990 | Powel et al. | |
| 4,907,758 | A | | 3/1990 | Powel et al. | |
| 4,919,359 | A | | 4/1990 | Powel et al. | |
| 4,936,523 | A | | 6/1990 | Powel et al. | |
| 5,029,762 | A | | 7/1991 | Behrens et al. | |
| 5,169,080 | A | * | 12/1992 | Bartkowiak | 242/476.1 |
| 5,211,354 | A | | 5/1993 | Rummage | |
| 5,328,121 | A | | 7/1994 | Rummage | |
| 5,495,087 | A | | 2/1996 | Rummage | |
| 5,711,142 | A | * | 1/1998 | Cromartie | 57/1 R |
| 5,875,626 | A | * | 3/1999 | Cromartie | 57/1 R |
| 6,073,868 | A | | 6/2000 | Stevens et al. | |
| 6,079,650 | A | | 6/2000 | Scaglia | |
| 6,352,214 | B1 | * | 3/2002 | Wild et al. | 242/474 |
| 6,561,453 | B1 | * | 5/2003 | Shinga | 242/595.1 |

* cited by examiner

*Primary Examiner*—Kathy Matecki
*Assistant Examiner*—Evan H Langdon
(74) *Attorney, Agent, or Firm*—Alston & Bird LLP

(57) ABSTRACT

A winding tube has a tubular body and a removable and replaceable end ring. The end ring has opposite end faces that, according to one embodiment, each define at least two recesses that form start-up regions between the end ring and the tubular body for capturing yarn during a winding operation. The recesses are spaced apart from one another so as to allow the end ring to be easily mounted and secured to the tubular body, and allowing the end ring to be reversible in relation to the tubular body.

37 Claims, 5 Drawing Sheets

YARN WINDING TUBE WITH REMOVABLE END RING

FIELD OF THE INVENTION

The present invention relates generally to yarn carriers and, more particularly, to yarn winding tubes suitable for high speed winding operations.

BACKGROUND OF THE INVENTION

For many years the textile industry has used winding operations to transfer yarn in packs from one processing operation to another. Yarn packs are formed by winding yarn onto carriers or winding tubes that are rotated at high speed, sometimes in excess of 6,000 RPM. The winding tubes, which are typically made of paperboard or plastic, are arranged consecutively so that the yarn can be transferred from one tube to the next without having to stop the winding process. To facilitate the winding process from one tube to the next, the tubes often define a start-up or pick-up groove in the body of the tube for capturing the yarn at the initial contact of the yarn and tube.

The lifespan of a conventional winding tube is limited, however, because the yarn wears down the start-up groove making it more difficult to capture yarn. Paperboard tubes are especially problematic, as moisture absorption by the paper tube may cause changes in dimension and other physical properties. Paper tubes also create paper dust and are more susceptible to being damaged. Plastic tubes have some improved wear characteristics over paper tubes, but plastic tubes are more costly to manufacture. Since tubes can be lost, damaged, or discarded after only a few uses, the cost of replacing plastic tubes may overshadow their longer lifespans compared to paper tubes.

The start-up groove of a conventional winding tube is typically formed by cutting or indenting the groove in the side of the tube body. However, some winding tubes incorporate an end ring on the end of the tube that forms a start-up groove with the tube body when the end ring is releasably secured thereto, such as by press fitting or by screwing a threaded end ring to the tube body. The start-up groove is defined by a scallop or indentation formed in the end ring and a shoulder defined by the tube when the end ring is secured to the tube. This design has an advantage over one-piece conventional tubes in that the end ring can be removed and replaced when the groove becomes worn by the yarn instead of replacing the entire winding tube. In addition, this design affords easier cleaning of the yarn that becomes trapped in the groove.

Thus, while removable end rings provide some advantages, further improvements can be made. In particular, conventional end rings are difficult to mount on the tube, as the indentation defined by the end ring typically extends a substantial portion, such as about 180°, around the end ring and thereby makes it difficult to accurately align the end ring against the tube. As such, the large indentation of the end ring can be inadvertently pressed against the tube, which "tilts" or misaligns the remainder of the end ring.

One possible solution could be to reduce the size of the indentation defined by the end ring. However, providing a smaller indentation may make it more difficult for the yarn to catch in the groove, as the yarn must be positioned at the precise location of the groove as the tube revolves. Another possible solution could be to provide a threaded end ring that can be screwed onto an end of the tube. Threaded end rings are also problematic, however, as they are more difficult to manufacture. The threads are also susceptible to damage over time, which eventually leads to replacement of the entire tube.

An important feature in winding tubes is the means for identifying the particular type of yarn that is wound on the tube without requiring a detailed inspection of the yarn. One conventional method of identifying the yarn type includes marking the end of the winding tube with a colored marker or the like, or by placing a sticker or painting a symbol on the end of the tube. While these methods identify the yarn during a particular winding operation, the markings may not be applicable to future yarns, which limits the marked tubes to a particular type of yarn. Thus, tubes must be maintained in inventory for each type of yarn, which adds to the cost and complexity of the winding operation.

Thus, there is a need for a winding tube that has a long lifespan and is easy to assemble, yet that can also identify a variety of yarn types depending on the particular yarn used in the winding operation.

SUMMARY OF THE INVENTION

The present invention relates to a winding tube for use in winding yarn or fibers about the tube in a winding operation, wherein yarn or fibers are wound thereon and unwound therefrom. According to one embodiment of the present invention, the tube includes an end ring defining at least two recesses in an end face thereof that are spaced apart from each other so that the end ring can be secured and aligned with the body of the tube while providing at least two start-up grooves for capturing the yarn. In another embodiment, the end ring defines at least two more recesses defined by the opposite end face of the end ring such that the end ring is reversible, which makes mounting the end ring easier when preparing the tube for the winding process.

In particular, a tube for use in a textile winding operation according to one embodiment of the present invention includes a body having opposed ends and an outer surface extending therebetween. The body defines a generally radially extending shoulder proximate at least one end thereof, and in one embodiment defines a shoulder at each end of the tube. The body has a reduced diameter portion that extends from the end of the tube to the respective shoulder.

The tube also includes an end ring having opposing end faces and that is operable to releaseably engage the end of the body proximate the shoulder. The end ring can be formed from a variety of materials, such as polymers, paperboards, composites, resins, metals, and combinations thereof. The end ring has an inner diameter adapted to mate with the reduced diameter portion of the body and defines at least two recesses in at least one of the opposing end faces thereof. Advantageously, each of the recesses forms a start-up region with the shoulder for capturing yarn. In one embodiment, the end ring defines two recesses in one end face and two recesses on the opposite end face. The recesses on each end face are evenly spaced apart about the circumference of the end ring according to a preferred embodiment, such as by about 180 degrees if two recesses are provided on an end face, and the recesses in each end face are circumferentially offset from the recesses of the opposite end face, such as by about 90 degrees if two recesses are provided on each end face. In this regard, the end ring is reversible so that at least two start-up regions are provided for capturing yarn regardless of the mounting orientation of the end ring in relation to the body of the tube. In addition, when the body of the tube has a shoulder at each end, an end ring according to the present invention can be utilized at either or both ends of the tube so that either end of the tube can be used to initially capture yarn during the winding operation.

The recesses can have many shapes, and preferably have a curved shape. The recesses can also be symmetrical or asymmetrical in the circumferential direction. In one embodiment, the recesses have an asymmetrical ramp shape that provides one start-up region per recess. In this case, oppositely oriented ramp-shaped recesses can be positioned along the same side of the end ring such that the tube can be rotated in either direction and still capture yarn. Symmetrical recesses are also capable of capturing yarn regardless of the tube's rotational direction.

The end ring also includes means for identifying the type of yarn to be captured during the winding operation. For example, in one embodiment the end ring is colored on at least a part of its surface to indicate a corresponding type of yarn. In this manner, the end ring can be removed and replaced on the body of the tube according to the type of yarn used in a particular winding process.

The winding tube of the present invention has a longer lifespan compared to conventional tubes, as the end rings can be replaced and/or discarded when they become worn instead of replacing the entire winding tube. In addition, the end ring of the present invention is easily aligned and secured to the body of the tube and defines recesses spaced along each end face of the end ring for forming start-up regions with the tube body. Furthermore, the end ring of the present invention can be selected so as to indicate what type of yarn is wound about the tube, which improves efficiency of the winding operation.

BRIEF DESCRIPTION OF THE DRAWINGS

Figure 1:
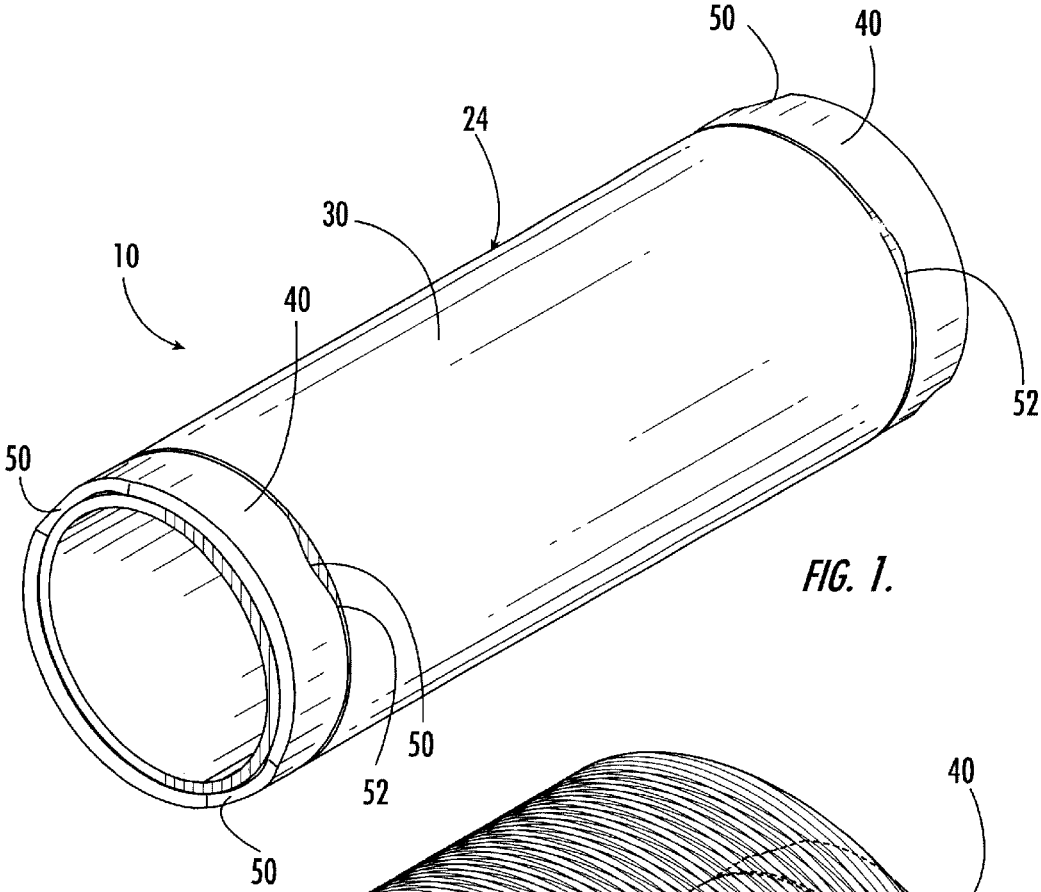
Figure 1A:
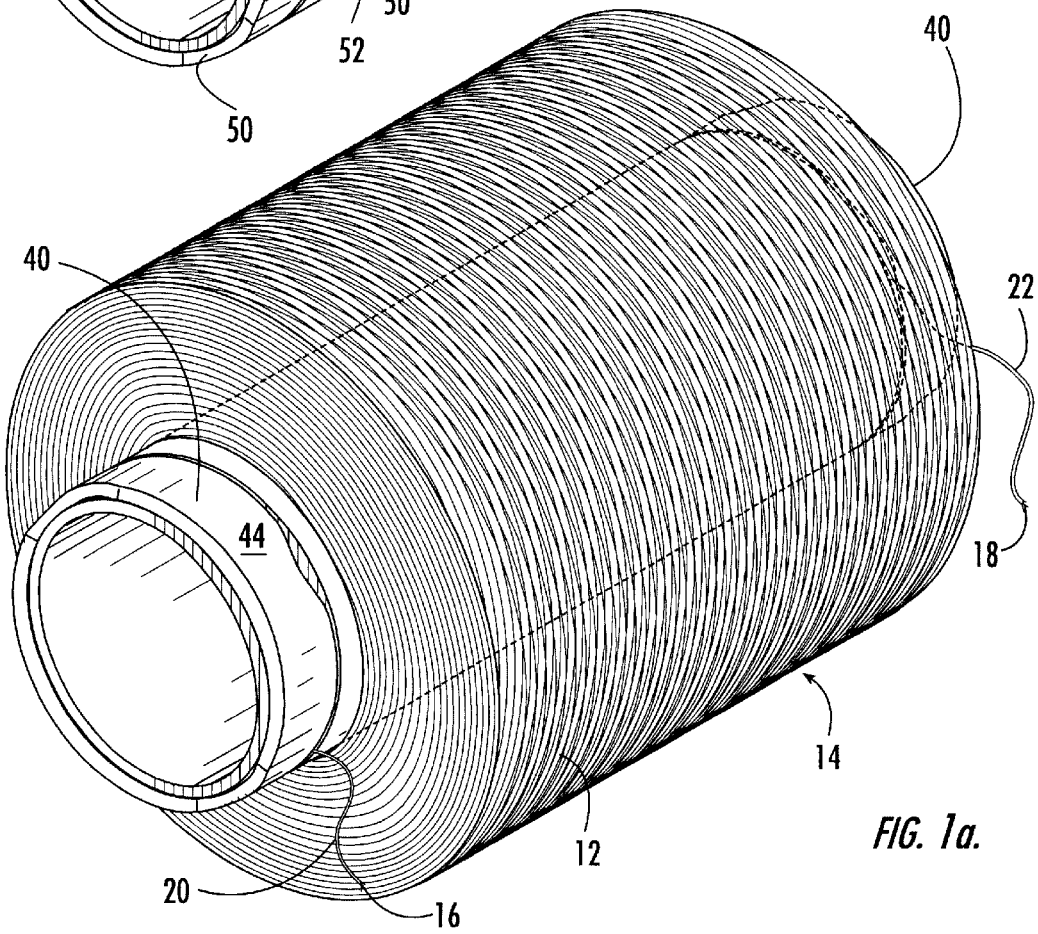
Figure 2:
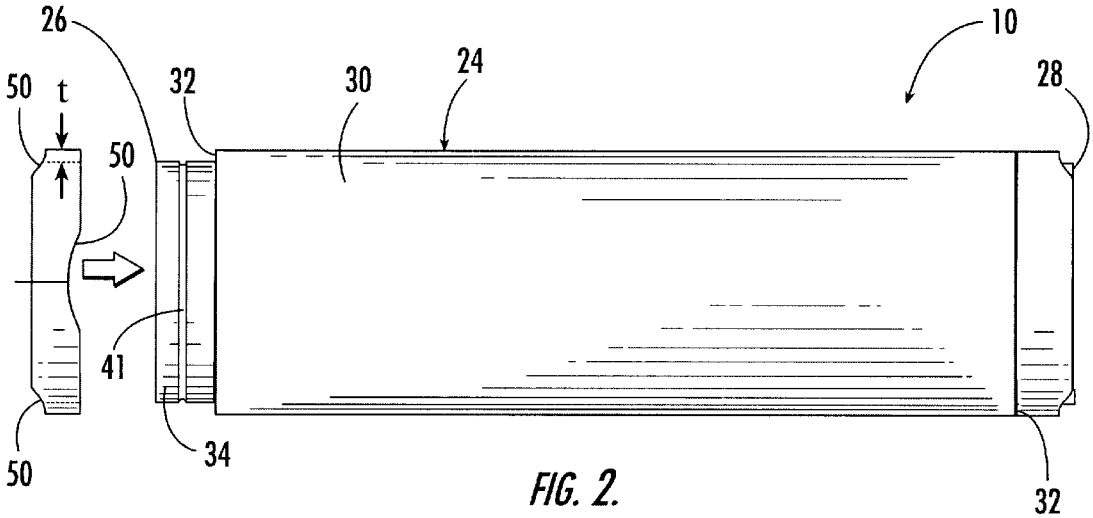
Figure 3:
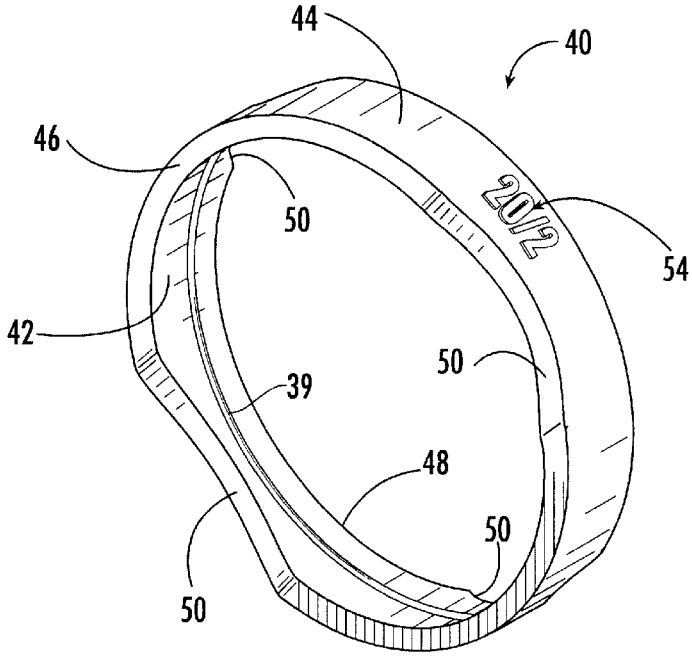
Figure 5:
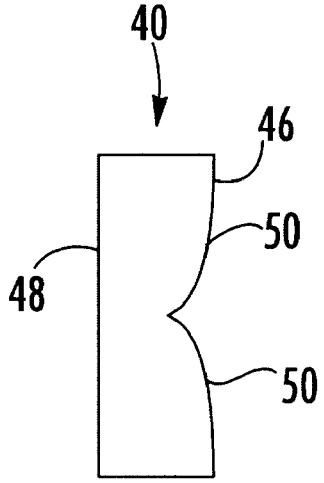
Figure 6:
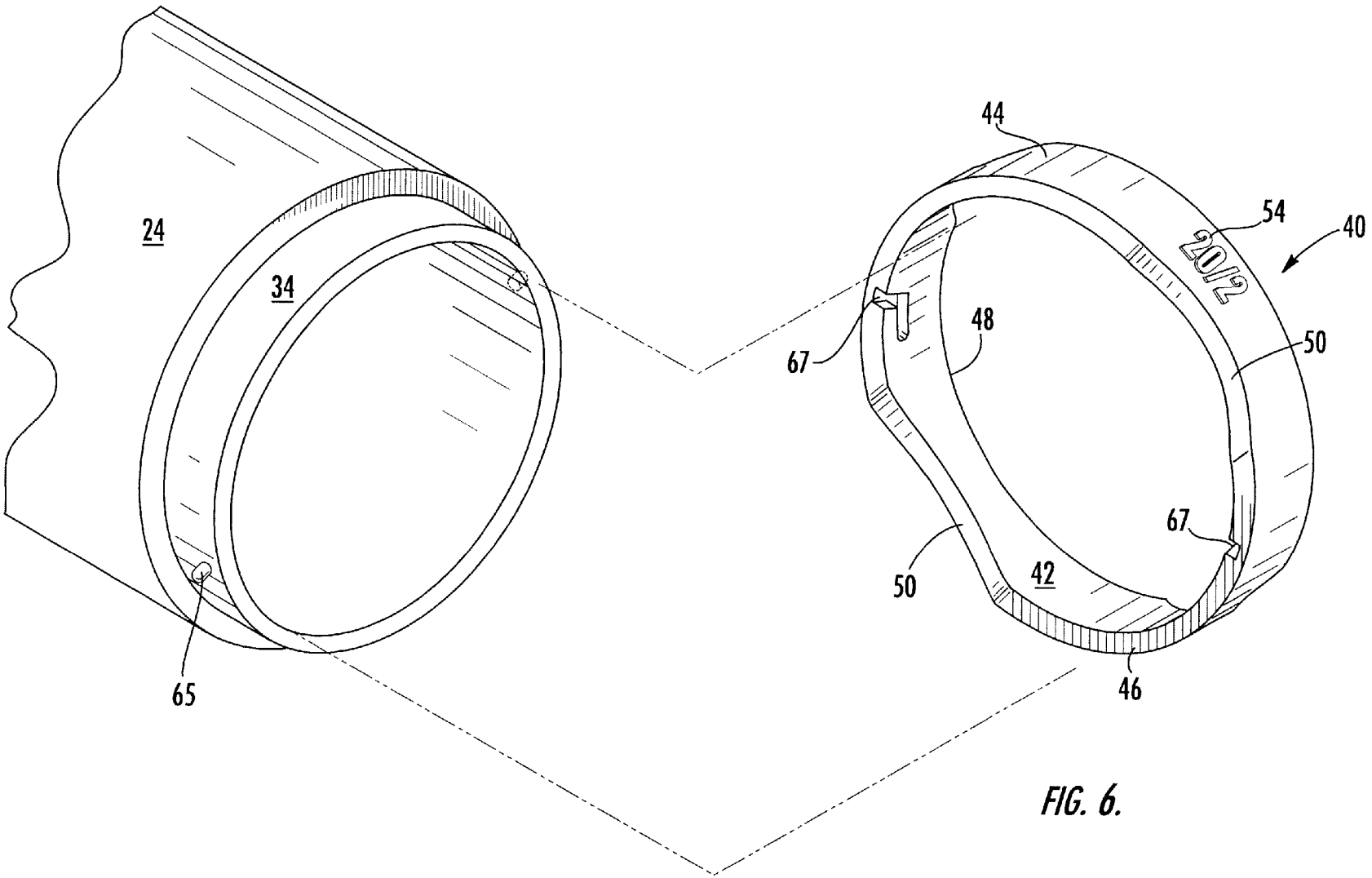
Figure 7:
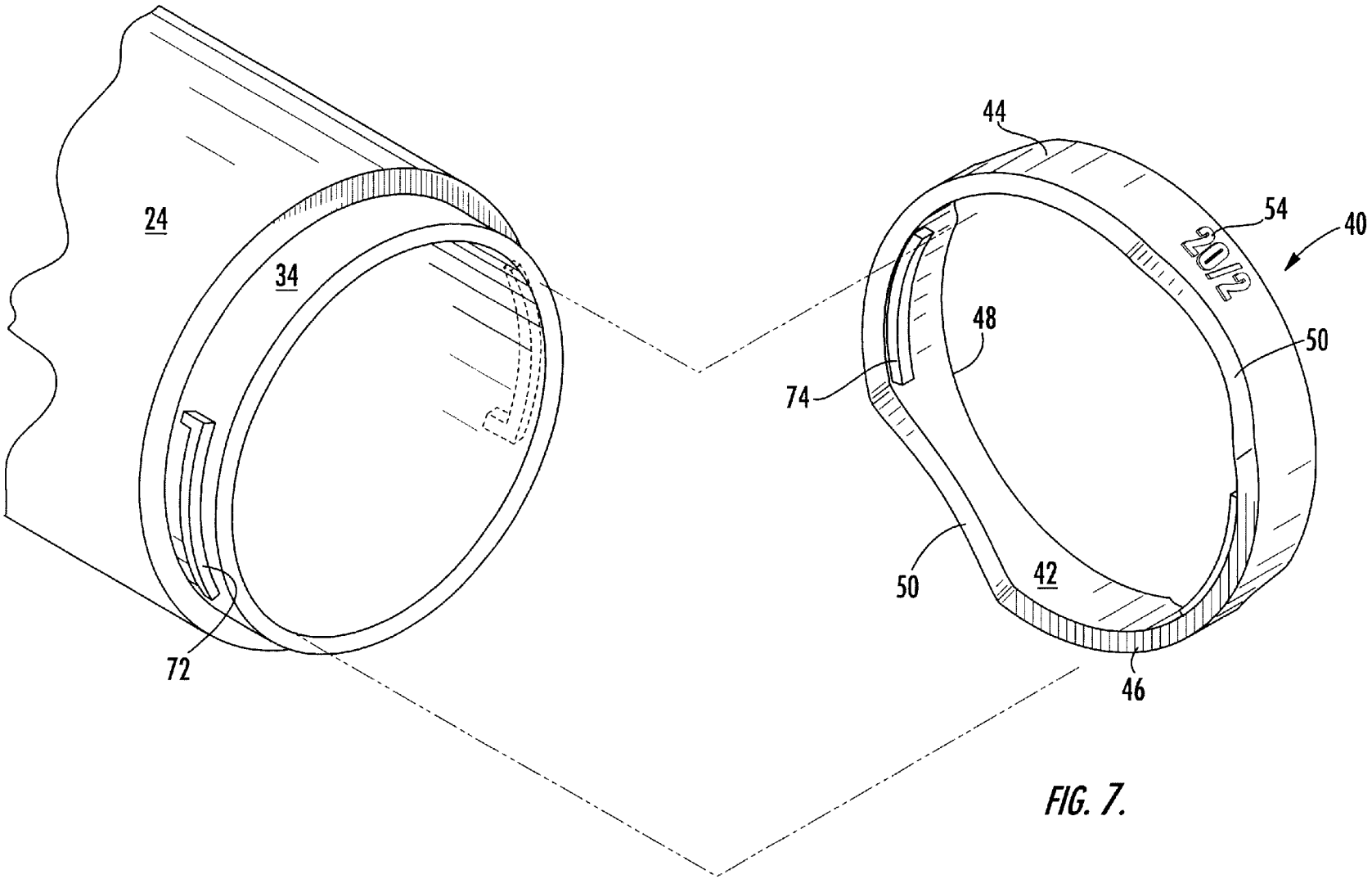

Having thus described the invention in general terms, reference will now be made to the accompanying drawings, which are not necessarily drawn to scale, and wherein:

FIGS. 1 and 1*a* are perspective side views of a winding tube according to one embodiment of the present invention;

FIG. 2 is an exploded side view of a winding tube according to one embodiment of the present invention;

FIG. 3 is a perspective side view of an end ring according to one embodiment of the present invention;

FIGS. 4*a*–4*d* show side views of various shapes of end rings according to the present invention;

FIG. 5 shows a side view of an end ring according to one embodiment of the present invention;

FIG. 6 shows a side perspective view of an end ring and an elongate body of a winding tube according to one embodiment of the present invention; and FIG. 7 shows a side perspective view of an end ring and an elongate body of a winding tube according to an alternative embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1–3 show various views of a winding tube 10 according to the present invention. The tube 10 is suitable for high speed yarn winding operations, such as during the manufacture of textiles. In this regard, a continuous strand of yarn 12 is wound about the tube 10 to form a pack 14. During the winding process, the yarn 12 is wound about a plurality of consecutively aligned tubes and transferred from one tube to the next by a yarn guide (not shown) according to known winding techniques. In particular, the yarn 12 includes a lead portion 20 that contacts the tube first and is wound about an end thereof, whereby the yarn is wrapped about the tube according to conventional practice to form the pack 14. The yarn 12 also includes a tail portion 22, as discussed more fully below.

The tube 10 includes a hollow, elongate body 24 that is formed of a durable material, such as paperboard, polymers (including thermoplastics), metal, resins, composites, and combinations thereof. The body 24 preferably is suitable for repeated use through many winding operations, and includes opposing ends 26, 28 and an outer surface 30 extending therebetween. It should be noted that the outer surface 30 of the body 24 is shown as having a solid appearance, but the outer surface and body could also be perforated or define openings therein, as is common with dye tubes and the like. The yarn 12 is wound into the pack 14 about the outer surface 30 of the body 24 of the tube 10. The body 24 also has a reduced diameter portion 34 at one of the ends 26, 28 to define a generally radially extending shoulder 32 and, in one embodiment, the body has reduced diameter portions and shoulders at both ends. In addition, the reduced diameter portions 34 can have smooth or rough surfaces. The radial distance between the outer surface 30 and reduced diameter portion 34 of the body 24 is shown as thickness t, which can vary in length, but is generally about one-third to two-thirds the thickness of the body, and preferably about one-half the thickness of the body.

The tube 10 also includes an end ring 40 that is sized to mate with a respective end 26, 28 of the body 24. More specifically, the end ring 40 has an inner surface 42 that engages the reduced diameter portion 34 of the tube body 24 in a frictional or press-fit relationship, and an outer surface 44 that is substantially flush with the outer surface 30 of the body 24 when the end ring 40 is secured to the body. The end ring 40 therefore has first and second end faces 46, 48 that have lengths or thicknesses that are substantially equivalent to the radial depth or thickness t of the shoulder 32. As mentioned above, the reduced diameter portion 34 of the tube body 24 can have a rough surface to further assist in the frictional relationship between the end ring 40 and the tube body. One or both end faces 46, 48 and/or the shoulder 32 may also have non-smooth or textured surfaces to assist in capturing yarn therebetween. The end ring 40 is preferably formed of a resilient and durable material. For example, the end ring can be formed from polymers, paperboards, composites, resins, metal, or combinations thereof.

FIGS. 3–5 show various embodiments of the end ring 40. In one embodiment, each end face 46, 48 of the end ring 40 defines at least two recesses 50. The end ring 40 can be formed so as to define at least two recesses 50 in only the first end face 46 thereof, although it is more desirable that each end face 46, 48 define recesses so that either end of the end ring can form a plurality of start-up regions 52 with the shoulder 32, as discussed below. The recesses 50 preferably have a curved shape, although other shapes are also possible.

Figure 4A:
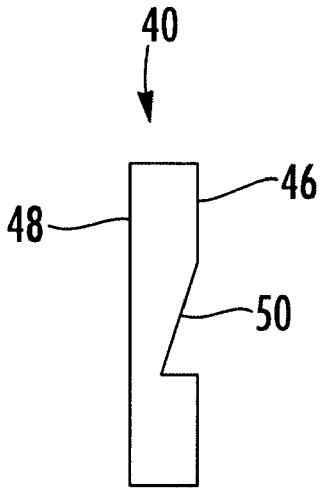
Figure 4B:
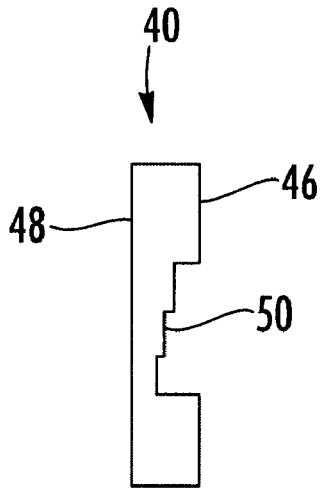
Figure 4C:
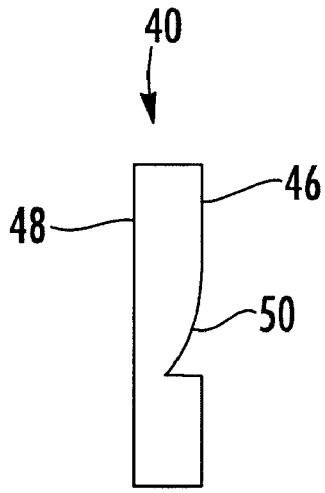
Figure 4D:
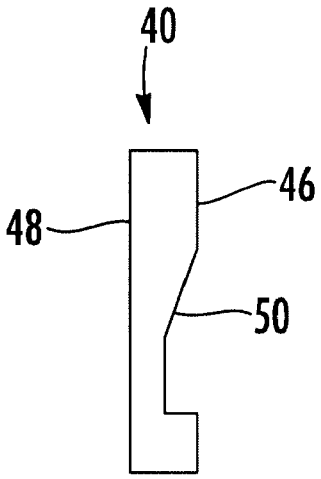

More specifically, FIGS. 4*a*–4*d* show various embodiment of the end ring 40, including end rings defining recesses 50 shaped as an asymmetrical ramp (FIG. 4*a*), a stepped ramp (FIG. 4*b*), a parabolic curve (FIG. 4*c*), and a modified asymmetrical ramp (FIG. 4*d*). As the embodiments shown in FIGS. 4*a*–4*d* are asymmetrical in shape, they are most effective when the tube 10 is rotated in a particular direction (clockwise as the end rings are depicted in FIGS. 4*a*–4*d*). The symmetrical recesses 50 shown in FIGS. 1–3 are effective for trapping yarn regardless of the rotational direction of the tube 10. In order to allow the end rings 40 shown in FIGS. 4*a*–4*d* to capture yarn regardless of the rotational direction of the tube 10, oppositely oriented recesses 50 can be positioned on the same side of the end ring 40. FIG. 5 shows such an arrangement using the parabolic curve shape shown in FIG. 4*c*. It should also be noted that while only a single recess 50 is shown in the embodiments of FIG. 4, more than one recess is possible on the same end face of the end ring 40, as well one or more recesses defined by the opposite end face of the end ring. Likewise, the embodiment shown in FIG. 5 could be repeated one or more times on each end face 46, 48 of the end ring 40.

The recesses 50 of the first end face 46 extend towards the opposite end face 48 of the end ring 40 (and vice versa if recesses are defined by the second end face), but generally do not extend more than about halfway between the opposing end faces 46, 48. In one embodiment, the recesses extend no more than one-third of the width of the end ring 40. In addition, the recesses 50 defined by a particular end face 46, 48 are preferably spaced apart about the circumference in a substantially even manner. For example, if two recesses 50 are defined by the first end face 46, the recesses are spaced about 180 degrees apart from one another. If three recesses 50 are defined, the recesses are spaced about 120 degrees from one another, and so on.

When the end ring 40 is mounted or secured to the tube body 24, the recesses 50 of the end ring and the shoulder 32 form corresponding start-up regions 52 for capturing the yarn 12 during the winding operation. In one embodiment, the first end face 46 of the end ring is positioned adjacent to the shoulder 32 of the tube body 24 so as to be in contact therewith except for the recesses 50, which are spaced from the shoulder to form the start-up regions 52. The end ring 40 preferably extends the length of the reduced diameter portion 34 of the tube body 24 so that the end ring and tube body are substantially flush at the respective end 26, 28 of the tube body when the end ring is mounted and releasably secured thereto. At least one, and preferably about 3–50, wraps of the yarn 12 are captured and retained in one or more of the start-up regions 52 while the tube 10 is rotated. The yarn guide then moves the yarn back and forth along the outer surface 30 of the tube body 24 to form the yarn pack 14.

As described above, the end ring 40 can be secured to the reduced diameter portion 34 of the body 24 with a frictional or interference fit. Other arrangements are possible, including a threaded, screw-on type arrangement or a snap fit. FIGS. 2 and 3 illustrate an alternative embodiment that includes a raised portion 39 extending from the inner surface 42 of the end ring 40 that mates with a groove 41 defined in the recessed portion 34 of the tube body 24 to form a snap fit. The circumferential friction between the end ring 40 and the recessed portion 34 of the body 24 is also important, as the startup regions 52 must be sufficiently stable in the axial and circumferential directions to capture and break the yarn 12 during the winding process. To further assist in capturing and breaking the yarn 12, the shoulder 32, recessed portion 34, and/or end face(s) 46, 48 may also be textured or the like.

FIG. 6 shows an alternative embodiment of the tube 10, wherein at least two locking members or pins 65 extend from the recessed portion 34 of the body 24. The pins 65 can be made of the same or different material forming the body 24, and may be added or applied to the recessed portion 34 during the manufacturing thereof. While the locking members 65 are shown as relatively pin-shaped, the locking members could have alternative shapes as long as the chosen shape permits sufficient locking of the end ring 40 and the body 24. As shown in FIG. 6, the end ring 40 defines opening or slots 67 that correspond to the pins 65 and are shaped to receive the pins and lock the end ring 40 to the body. In one embodiment, the slots 67 have a detent or "L" shape that bias the pins 65 during the locking process, which in the embodiment shown in FIG. 6 would include inserting the pins 65 into the slots 67 and rotating the end ring 40 relative to the body 24 until the pins lock the end ring in place. Further to the embodiment shown in FIG. 6, it is possible that slots 67 are defined on both sides of the end ring 40. It is also possible to have pins extending on respective ends of the tube 10.

FIG. 7 shows yet another alternative embodiment of the tube 10, wherein at least two L-shaped locking members 72 extend from the recessed portion 34, and corresponding locking members 74 extend from the inside surface 42 of the end ring 40. To lock the end ring 40 to the body 24, the end ring is slid or positioned over the recessed portion 34 and rotated such that the locking members 74 of the end ring engage and abut the L-shaped locking members 72 of the body.

At the beginning of the winding operation for a particular tube 10, the continuous strand of yarn 12 is moved by the yarn guide from a finished yarn pack to the empty tube 10. The yarn 12 is captured in the start-up region of the tube 10 while the tube rotates. The yarn 12 is then broken at the lead portion 20 to form a lead end 16 by stopping or moving the preceding tube having the finished yarn pack wound thereupon while the tube 10 continues to rotate. When the tube 10 has received a predetermined amount of yarn 12, the tail portion 22 of the yarn is moved to a following rotating tube where it is captured by a start-up region thereof. The relative movement of the tube 10 and the following tube breaks the tail portion 22 of the yarn 12 to form a tail end 18. Thus, the tail portion 22 associated with the tube 10 is broken to form the tail end 18 (and a corresponding lead end of the following tube). The process is then repeated for the next tube and so on to form as many yarn packs as desired.

As described above, FIG. 3 shows one embodiment of the end ring 40, wherein the end ring defines at least two recesses 50 on each end face 46, 48 thereof. In this regard, the end ring 40 can be reversed so that the recesses 50 of either end face 46, 48 can form the start-up regions 52 with the respective shoulder 32. It is also desirable for the double-faced configuration shown in FIG. 3 to circumferentially offset the recesses 50 on the first end face 46 from the recesses on the second end face 48 so that the recesses of each end face do not interfere with the recesses of the opposite end face. For example, in one embodiment wherein the first end face 46 of the end ring 40 has two recesses 50 spaced at about 180 degrees apart, and the second end face 48 has two recesses 50 spaced about 180 degrees apart, the recesses on the first end face are rotated or offset about 90 degrees from the recesses on the second end face. Advantageously, this design allows an operator to quickly engage the end ring 40 and the tube body 24 without determining which end face defines the recesses 50 for forming the start-up regions 52. In addition, spacing the recesses 50 as described above allows the end ring 40 to be substantially balanced, which helps prevent the end ring from being mounted unevenly against the tube body 24.

Another feature of the end ring 40 is that the end ring can be easily removed and replaced when necessary or desired. For instance, repeated winding operations may cause the recesses 50 of the end ring 40 to degrade slightly over time due to repeated contact with the yarn 12. When this occurs, the end ring 40 can be removed and reversed to employ the recesses 50 on the opposite end face of the end ring to effectively double the lifespan of the end ring. When both end faces 46, 48 of the end ring 40 become worn, the end ring can be discarded and replaced with a new end ring, which is much less expensive than discarding the tube body 24 or entire tube 10. Another advantage is that the end ring 40 can be removed so that any yarn 12 that is caught or stuck in the start-up regions 52 can be easily removed after the winding operation.

The end ring 40 in one embodiment also includes a visible indicator 54 for identifying the type of yarn used in the winding process. In a preferred embodiment, the visible indicator 54 can be one or more colors on at least a part, and preferably all, of the end ring 40. The visible indicator 54 can also be in the form of lines, letters, numerals, or geometric shapes that correspond with a particular yarn. Bar codes and the like may also be used, and a label recess (not shown) may be provided so that removable labels can be applied without extending radially past the outer surface 44 of the end ring 40. As shown in FIG. 3, for example, writing such as "20/2" to indicate 20's 2-ply yarn can be included on the surface of the end ring 40 so that an operator can quickly and easily determine the type of yarn in the pack 14 without having to closely inspect the yarn. In addition, the end ring 40 can be removed and replaced depending on the type of yarn 12 used in the particular winding operation, which thereby eliminates the need to keep specific tube bodies on hand that correspond to a particular type of yarn.

Accordingly, the tube 10 of the present invention provides several advantages over conventional winding tubes. In particular, the end ring 40 provides at least two recesses 50 that are preferably evenly spaced from each other so that the end ring can be mounted flush against the shoulder 32 of the tube body 24. In addition, the multiple recesses 50 of the end ring 40 provide more start-up regions 52 to capture the yarn 12 than conventional winding tubes. Furthermore, the end ring 40 preferably defines a plurality of recesses 50 on both end faces 46, 48 thereof so that the end ring can be releasably secured to the tube body 24 regardless of which end face is adjacent the shoulder 32 and/or regardless of the rotational winding direction of the tube.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. For example, if start-up regions 52 are desired at only one end of the tube 10 and the tube body 24 includes reduced diameter portions 34 at both ends 26, 28, an end ring defining no recesses can be secured to one end of tube body while another end ring defining recesses as discussed herein can be secured to the other end of the tube body. Alternatively, an end ring defining recesses on only one end face can be secured to one end of the tube body so that the recesses are not adjacent the shoulder at the corresponding end. Although specific terms are employed herein, they are used in a generic and descriptive sense only and not for purposes of limitation.

That which is claimed:

1. A tube on which yarn is wound to form a yarn pack, comprising:

a tubular body extending lengthwise between opposed ends thereof and having an outer surface defining an outer diameter of the body, the body having a reduced diameter portion extending lengthwise from at least one end of the body partway toward the other end so as to define a generally radially extending shoulder; and a press-fit end ring having opposite end faces and being operable to releaseably engage the at least one end of the body proximate the shoulder, the end ring having an inner diameter adapted to mate with the reduced diameter portion of the body, the end ring defining at least two recesses in at least one of the end faces thereof, the at least two recesses and the shoulder forming a plurality of start-up regions for capturing yarn therebetween.

2. A tube according to claim 1, wherein the end ring includes a visible indicator for identifying the yarn to be captured in the winding operation.

3. A tube according to claim 1, wherein the end ring is formed from a material selected from the group consisting of polymer, paperboard, composite, resin, metal, and combinations thereof.

4. A tube according to claim 1, wherein the shoulder defined by the body is located at least about ⅛" from the at least one end thereof.

5. A tube according to claim 1, wherein each end of the body has the reduced diameter portion and shoulder, and further comprising a pair of end rings for releaseably engaging the reduced diameter portions of the body.

6. A tube according to claim 1, wherein the at least two recesses defined by the end ring are evenly spaced about the circumference of the end ring.

7. A tube according to claim 1, wherein at least one of the at least two recesses defined by the end ring has a curved shape.

8. A tube according to claim 1, wherein one of the end faces of the end ring is positioned adjacent the shoulder, and the other of the end faces of the end ring is substantially flush with an end of the body.

9. A tube according to claim 1, wherein at least one of the at least two recesses has an asymmetrical shape.

10. A tube according to claim 1, wherein the end ring defines at least one recess having an asymmetrical shape in each end face thereof.

11. A tube according to claim 1, wherein one of the group consisting of at least one of the end faces of the end ring and at least one of the opposed ends of the tubular body includes at least one locking member extending therefrom, and the other of the group defines at least one corresponding opening for receiving the at least one locking member to releasably lock the end ring and the tubular body.

12. A tube according to claim 11, wherein the at least one of the opposed ends of the tubular body includes at least two locking members extending therefrom, and the at least one of the end faces of the end ring defines corresponding openings for receiving the at least two locking members to releasably lock the end ring and the tubular body.

13. A tube according to claim 1, wherein one of the group consisting of at least one end ring and at least one of the opposed ends of the tubular body includes a plurality of first locking members extending therefrom, and the other of the group includes a plurality of corresponding second locking members extending therefrom that together are capable of releasably locking the end ring and the tubular body.

14. A tube according to claim 1, wherein at least a part of one area selected from the group consisting of the radially extending shoulder of the tubular body, the reduced diameter portion of the tubular body, and an end face of the end ring has a surface other than smooth.

15. A tube according to claim 14, wherein the selected area surface is selected from the group consisting of textured, embossed, sandblasted, coated, etched, and combinations thereof.

16. A tube on which yarn is wound to form a yarn pack, comprising:

a tubular body extending lengthwise between opposed ends thereof and having an outer surface defining an outer diameter of the body, the body having a reduced diameter portion extending lengthwise from at least one end of the body partway toward the other end so as to define a generally radially extending shoulder; and a removable and replaceable end ring having opposite end faces and being operable to releaseably engage the at least one end of the body proximate the shoulder, the end ring having an inner diameter adapted to mate with the reduced diameter portion of the body, the end ring defining two recesses in each of the end faces thereof, the recesses defined by each of the end faces being spaced apart by at least about 90 degrees, wherein the shoulder and the two recesses of one of the end faces form a plurality of start-up regions for capturing yarn.

17. A tube according to claim 16, wherein the end ring includes a visible indicator for identifying the yarn to be captured in the winding operation.

18. A tube according to claim 16, wherein the end ring is formed from a material selected from the group consisting of polymer, paperboard, composite, resin, metal, and combinations thereof.

19. A tube according to claim 16, wherein the shoulder defined by the body is located at least about ⅛" from the at least one end thereof.

20. A tube according to claim 16, wherein each end of the body has the reduced diameter portion and shoulder, and further comprising a pair of end rings for releaseably engaging the ends.

21. A tube according to claim 16, wherein the two recesses of the other end face form a plurality of start-up regions with the body when the end ring is reversed.

22. A tube according to claim 16, wherein the two recesses in each of the end faces of the end ring are evenly spaced about the circumference of the end ring.

23. A tube according to claim 16, wherein at least one of the two recesses in each of the end faces of the end ring has a curved shape.

24. A tube according to claim 16, wherein one of the end faces of the end ring is positioned adjacent the shoulder, and the other of the end faces of the end ring is substantially flush with an end of the body.

25. A tube according to claim 16, wherein at least one of the at least two recesses has an asymmetrical shape.

26. A tube according to claim 16, wherein the end ring defines at least one recess having an asymmetrical shape in each end face thereof.

27. A tube according to claim 16, wherein the at least two recesses include at least two asymmetrically shaped recesses defined in at least one of the end faces, the at least two asymmetrically shaped recesses being oriented in opposite directions to form a plurality of start-up regions for capturing yarn regardless of rotational direction of the tube.

28. A tube according to claim 16, wherein one of the group consisting of at least one of the end faces of the end ring and at least one of the opposed ends of the tubular body includes at least one locking member extending therefrom, and the other of the group defines at least one corresponding opening for receiving the at least one locking member to releasably lock the end ring and the tubular body.

29. A tube according to claim 28, wherein the at least one of the opposed ends of the tubular body includes at least two locking members extending therefrom, and at least one of the end faces of the end ring defines corresponding openings for receiving the at least two locking members to releasably lock the end ring and the tubular body.

30. A tube according to claim 16, wherein one of the group consisting of at least one end ring and at least one of the opposed ends of the tubular body includes a plurality of first locking members extending therefrom, and the other of the group includes a plurality of corresponding second locking members extending therefrom that together are capable of releasably locking the end ring and the tubular body.

31. A tube according to claim 16, wherein at least a part of one area selected from the group consisting of the radially extending shoulder of the tubular body, the reduced diameter portion of the tubular body, and an end face of the end ring has a surface other than smooth.

32. A tube according to claim 31, wherein the selected area surface is selected from the group consisting of textured, embossed, sandblasted, coated, etched, and combinations thereof.

33. A method for winding yarn about a tube for supporting a yarn pack, comprising:

providing a tubular body having a reduced diameter portion on at least one end thereof such that a radially extending shoulder is defined at an outer surface of the body;

releasably securing an end ring defining at least two recesses on a first end face thereof to the tubular body so that start-up regions are defined between the recesses and the shoulder of the tubular body;

removing the end ring from the tubular body;

reversing the end ring relative to the tubular body;

releasably securing the end ring to the tubular body so that at least two start-up regions are formed between at least two recesses defined by a second end face of the end ring and the shoulder of the tubular body; and winding yarn about the tube such that the yarn is captured in at least one of the start-up regions.

34. A method according to claim 33, wherein the providing step includes providing a tubular body having a reduced diameter portion at each end thereof, and wherein the end ring securing step includes securing an end ring to each end of the tubular body at the corresponding reduced diameter portion.

35. A method according to claim 33, wherein the end ring securing step includes inserting at least one locking member extending from one of the end ring and the tubular body into a opening defined by the other of the end ring and the tubular body and rotating the end ring and the tubular body relative to one another to releasably lock the end ring to the tubular body.

36. A method according to claim 33, wherein the end ring securing step includes releasably locking at least two first locking members extending from one of the end ring and the tubular body with at least two corresponding second locking members extending from the other of the end ring and the tubular body.

37. A method according to claim 33, wherein the winding step includes capturing the yarn regardless of rotational winding direction of the tube.

* * * * *

UNITED STATES PATENT AND TRADEMARK OFFICE

CERTIFICATE OF CORRECTION

PATENT NO. : 6,732,964 B2
DATED : May 11, 2004
INVENTOR(S) : Couchey

It is certified that error appears in the above-identified patent and that said Letters Patent is hereby corrected as shown below:

Column 8,
Line 10, after "a" delete "press-fit".
Line 18, after the word "between" delete the "." and add --, wherein the at least two recesses include at least two asymmetrically shaped recesses defined in at least one of the end faces, the at least two asymmetrically shaped recesses being oriented to form a plurality of start-up regions for capturing yarn regardless of rotational direction of the tube. --

Signed and Sealed this

Tenth Day of August, 2004

JON W. DUDAS
*Acting Director of the United States Patent and Trademark Office*